US005597039A

United States Patent [19]

Rieger

[11] Patent Number: 5,597,039

[45] Date of Patent: Jan. 28, 1997

[54] EVAPORATOR TUBE

[75] Inventor: Klaus K. Rieger, Simons Island, Ga.

[73] Assignee: High Performance Tube, Inc., Warren, N.J.

[21] Appl. No.: 549,042

[22] Filed: Oct. 27, 1995

Related U.S. Application Data

[63] Continuation-in-part of Ser. No. 217,092, Mar. 23, 1994, abandoned.

[51] Int. Cl.[6] ..... F28F 1/42

[52] U.S. Cl. ..... 165/133; 165/179; 165/184; 165/DIG. 516; 165/DIG. 520

[58] Field of Search ..... 165/133, 179, 165/184

[56] References Cited

U.S. PATENT DOCUMENTS

| | | | |
|---|---|---|---|
| 4,059,147 | 11/1977 | Thorne | 165/133 |
| 4,195,688 | 4/1980 | Fujie et al. | 165/133 |
| 4,438,807 | 3/1984 | Mathur et al. | 165/133 |

FOREIGN PATENT DOCUMENTS

| | | | |
|---|---|---|---|
| 16766 | 2/1979 | Japan | 165/133 |
| 18327 | 9/1981 | Japan | 165/133 |
| 29997 | 2/1984 | Japan | 165/133 |
| 172892 | 7/1988 | Japan | 165/133 |

*Primary Examiner*—Leonard R. Leo

*Attorney, Agent, or Firm*—Richard T. Laughlin, Esq.; Graham, Curtin & Sheridan

[57] ABSTRACT

A heat transfer tube for use in a refrigeration evaporator. This tube includes an outer surface with axially spaced bent fins which form and enclose annular tunnels. The bent fins have top edge portions which have peripherally spaced sets of notches of different sizes on the same fin convolution and refill gaps for fluid flow to the tunnels for heat transfer through the annular wall. The concept of placing different pore sizes next to each other on the same fin allows a more efficient use of the tube's surface area for evaporative heat transfer.

8 Claims, 3 Drawing Sheets

EVAPORATOR TUBE

This application is a continuation-in-part of U.S. patent application Ser. No. 08/217,092 filed Mar. 23, 1994, now abandoned.

FIELD OF THE INVENTION

The invention generally relates to an evaporator tube for use in a refrigeration unit and, in particular, the invention relates to such a tube which has outer subsurface tunnels with regulated refill passages and notches of different size on the same fin, and method of manufacture of such tubing.

BACKGROUND OF THE INVENTION

Evaporator tubes are utilized in a refrigeration unit for evaporating the coolant to produce the desired degree of cooling. Most evaporator tubes which depend on controlled gaps on powder metal surfaces have a common problem in that the tubes either flood the media reservoir or starve the replenishing of fluid. The commercial tubes available in the industry have varying pore sizes, but with only one pore size on the same fin. As a general rule, the prior art tubes are prepared by firming the outside of a tube to produce spiral grooves. Notches are cut into the fins at various intervals and, in some instances, some of the outer tips of the fins are folded over to contact the surface of the tube forming a passageway. The problem of efficient heat transfer tubing has been intensified because of environmental problems requiring the discontinuance of efficient refrigerants. As of this time, the newer refrigerants do not have the efficiency experienced by the banned refrigerants. Because of this variety of refrigerants, there is a need for a tube which can readily be adapted to a variety of different types of refrigerants.

U.S. Pat. No. 4,438,807, issued to Achint P. Mathur et al. on Mar. 27, 1984, discloses a heat transfer tube which has some fins bent over and it creates openings dependent upon the internal ribs to form smaller fins on the external surface of the tubing above them, causing the bent over fins to have gaps consistent with the decreased fin height. The openings can only be present when there is an internal fin present at the location to supply sufficient metal. All of the openings are the same size. The geometry displayed in this patent does not function effectively. If tube material is sucked into the groove on the mandrel as explained in column 6, lines 7 to 10, then effective fin height is reduced for that section of the tube. Since the adjacent fin has not been moved forward or backward, the cavity opening is actually triangular in shape and not the diamond shape illustrated in FIG. 3 of this patent. Its existence must depend upon the difference in fin height between adjacent fin convolutions before they are bent over.

Japanese Patent No. 1-87036, dated Mar. 31, 1989 filed by Hisashi Nakayama, has holes and pores which are not integral to the fin material and, in additional, are material placed over the finned surface which is then holed using an electrode which burns the circular hole through the overlaid material only after rollover. In order for that system to work, the rolled over fins cannot be completely rolled over to touch the adjacent fin, otherwise the tunnel is completely enclosed and the electrode is only stated to melt the "low conductive material."

Japanese Patent No. 63-172892, dated Jul. 16, 1988 issued to Hiromi Hashimoto, discusses tunnel cavities of an equal cross sectional area (tunnel 12 being larger than tunnel 8) which causes the rolled over fins to not completely touch along the outside diameter circumference. Further, all notches are of the same size. This patent places pores of the same size in groups as increasing heat flux to the surface will tend to activate single, broad portions of the tube's surface for nucleate boiling since refill pores are farther away. In addition, it has been found that broad groups of pores of the same size will effectively starve many of the activated pores of refrigerant, such that not all of the pores in the activated area will be available for nucleate boiling. This effect shows up as gaps and low values in the tube's nucleate boiling performance. Placing many pores of the same size in groups as increasing heat flux is supplied to the surface will tend to only activate single, broad portions of the surface of the tube for nucleate boiling since refill pores are further away. This effect in real terms will appear as gaps and low values in the nucleate boiling performance of the tube.

U.S. Pat. No. 4,059,147 issued to Thorne is similar to Mathur in that the notches or recesses are of uniform shape.

SUMMARY OF THE INVENTION

It is an object of the invention to produce a refrigerant tubing which is adaptable to produce a high level of performance over a broad range of heat fluxes. Another object of the invention is to provide an expedient method for producing such a tubing. It is a further object of the invention to produce an efficient system whereby a refrigerant tubing has no gaps in the performance of heat exchange. Other objects and the advantages of the invention will appear from the following description.

According to the present invention, an evaporation tube is provided which has different pores sizes located on the same fin. In accordance with the invention, over 455 different combinations of pores sizes are currently possible. The tube has an elongated axis with an inner wall surface and an outer wall surface. The outer surface has a plurality of axially spaced extending ribs which are bent over forming respective subsurface tunnels. The bent ribs have edge portions with spaced refill passages and with notches of different sizes on the same fin. The inner wall surface can have a plurality of inner spiral ribs for additional heat transfer if desired.

By using bent fins having subsurface tunnels with refill passages and varying notch sizes, a refill of coolant into the subsurface tunnels can be controlled, and boiling can be optimized in the evaporator tube. Placing differently sized pores immediately adjacent to each other on the same fin insures that all active pores can be continuously supplied and not starved of refrigerant. The result is that there are no gaps in the performance of the tube characteristics, since as the supplied heat flux changes and one pore size starts to deactivate, the next pore size immediately adjacent to it will start to activate and continue the nucleate boiling process with very little loss in energy.

DESCRIPTION OF THE PREFERRED EMBODIMENT

Figure 1:
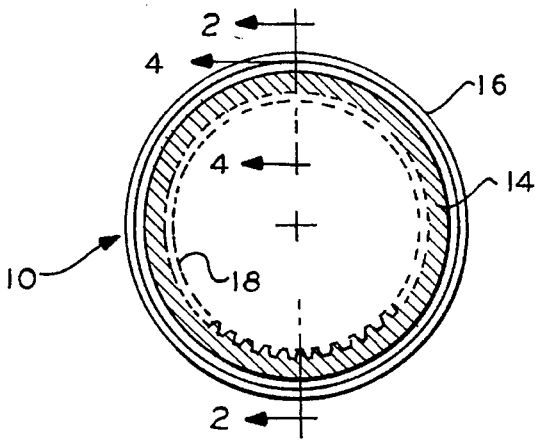
FIG. 1 is a section view of the proposed tube.
Figure 2:
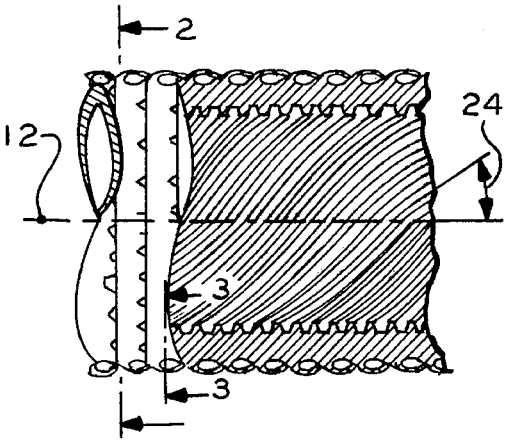
FIG. 2 is a section view along line 2—2 of FIG. 1.
Figure 3:
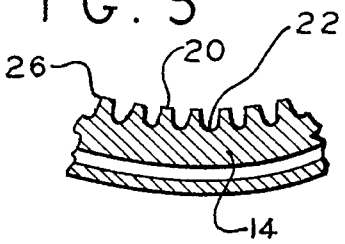
FIG. 3 is an enlarged view as taken along line 3—3 of FIG. 2.

As shown in FIGS. 1, 2 and 3, a tube generally indicated at 10 is provided. The tube 10 has an elongated axis 12 and has an annular wall 14. Wall 14 has an outer surface 16 and an inner surface 18.

Figure 4:
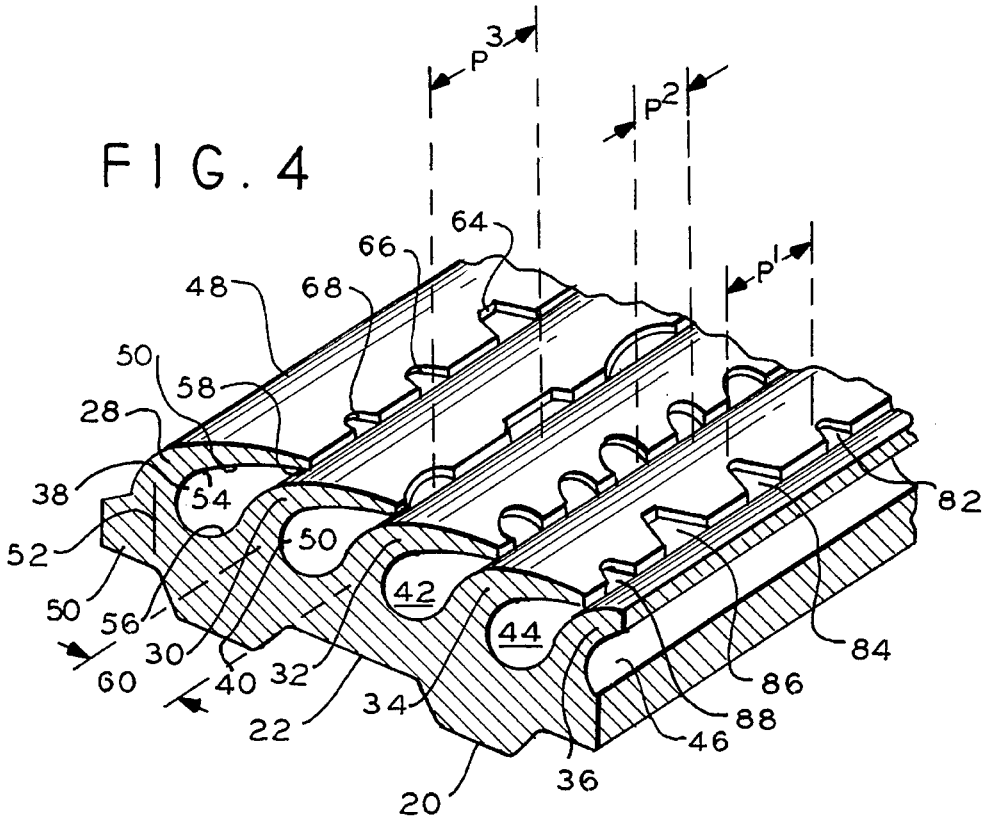
FIG. 4 is an enlarged section view as taken along line 4—4 of FIG. 1.
Figure 5:
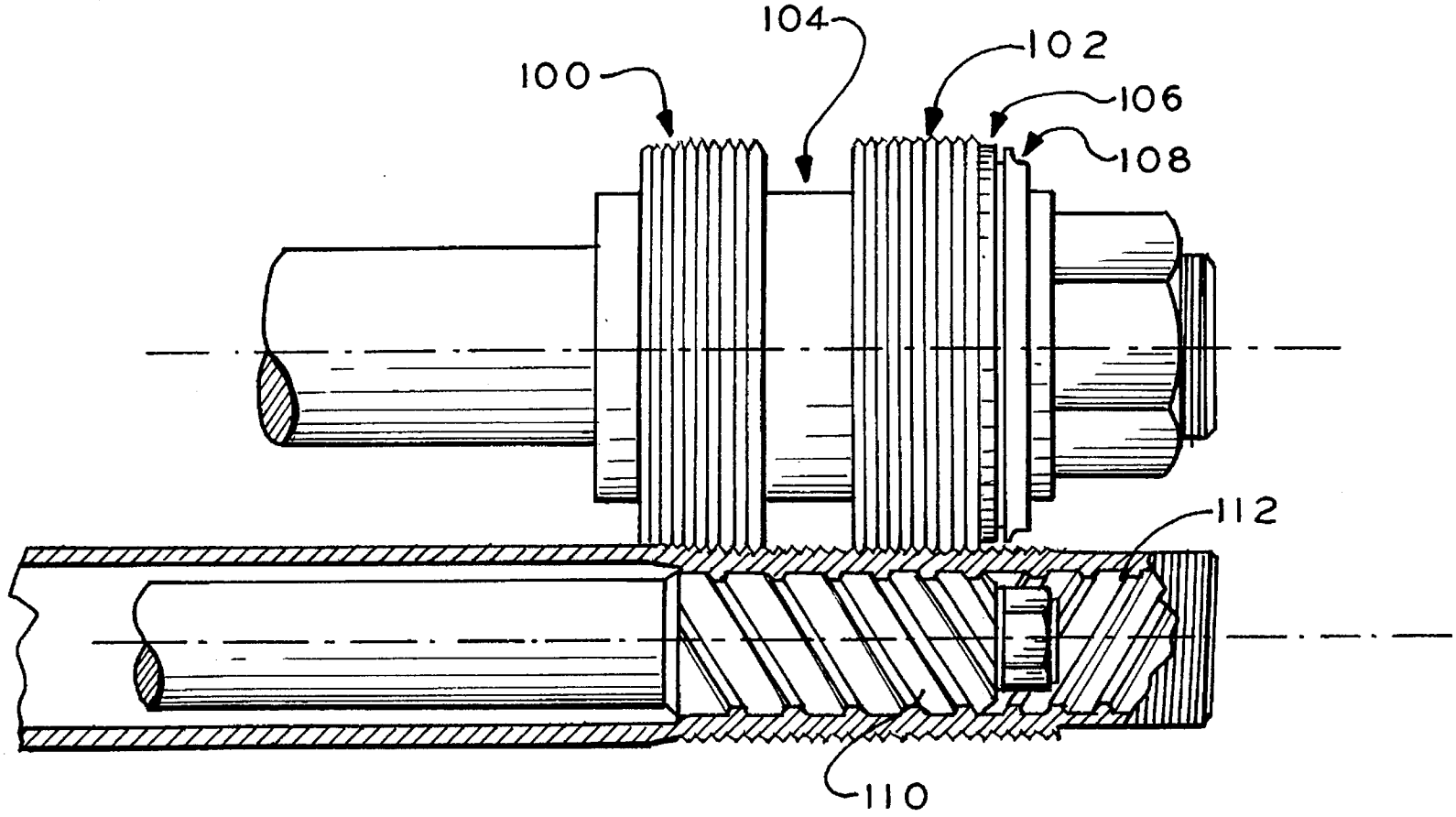
FIG. 5 illustrates the apparatus for producing the tube of the invention.
Figure 6:
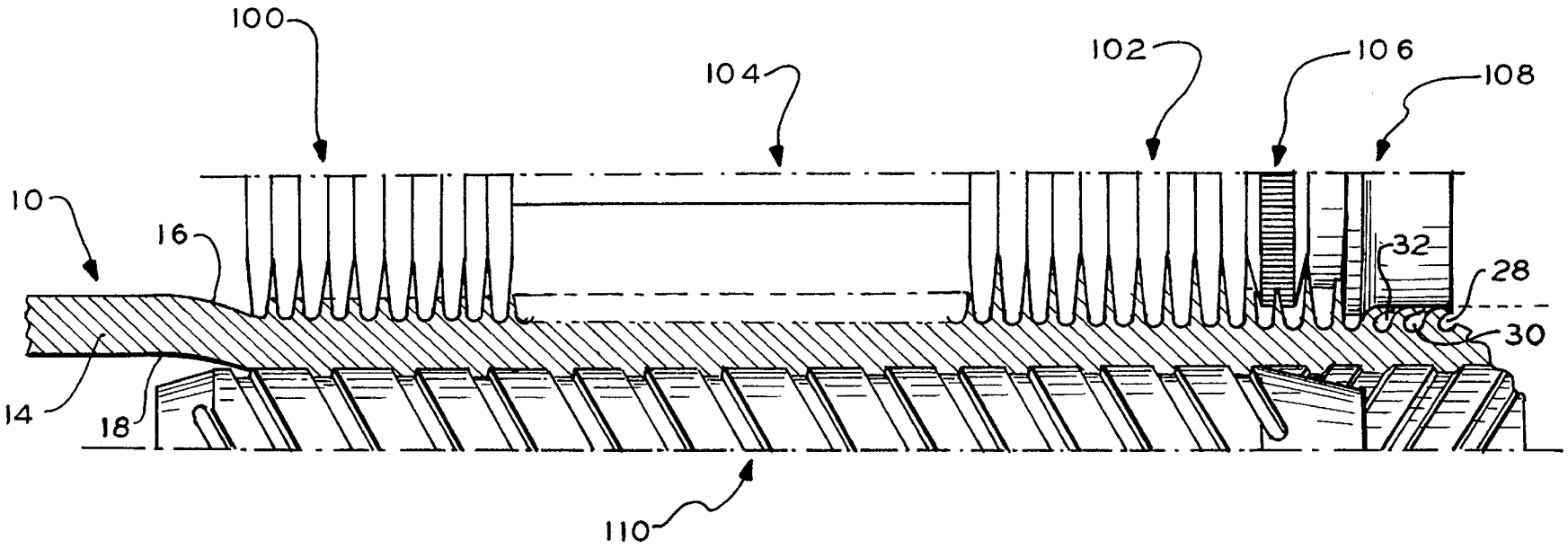
FIG. 6 is an enlarged view of the apparatus.

As shown in FIGS. 3 and 4, the inner surface 18 has a plurality of inner spiral ribs 20. The inner ribs 20 have respective grooves 22, which are disposed therebetween. Inner ribs 20 have a spiral angle 24 (FIG. 2). Each of the ribs has a rib height 26.

As shown in FIGS. 2 and 4, outer surface 16 has a plurality of bent fins 28, 30, 32, 34, 36, which form respective subsurface tunnels or cavities or pockets 38, 40, 42, 44, 46. The typical fin 28 has a top edge portion or radially outer portion 48, and has a bottom or radially inner portion 50. Bottom portion 50 has a centerline 52 which is disposed in a reference plane that is normal to axis 12. The typical tunnel 38 is formed by sidewall surfaces 54, 56. Top edge portion 48 has a contact line or a zero gap line 58, which typical bent rib 28 contacts the adjacent rib 30. Typical bent rib 28 has a longitudinal rib pitch or spacing 60 to the adjacent rib 30. For ease of illustrating the top edge portions 48, FIG. 4 section view is taken along line 4—4 of FIG. 1. The ribs 28 30 32 34 36 each has a plurality of refill passages or gaps 62 and each has a plurality of sets of V-shaped notches or pores 64, 66, 68. The bent ribs 30, 32, 34, 36 have similar respective refill openings or gaps 82, 84, 86, and pluralities of notches. Refill gap 82 and notch 84 have a typical, transverse, peripheral spacing or pitch $P^1$. The notches and refill gaps are arranged in sets of 4 notches and 1 refill gap. The pores pitches which can be achieved are designated as $P^1$, $P^2$ and $P^3$.

In this embodiment, the outside diameter of tube 10 has a size which is about 0.750 to 1.250 inches. Bent fins 28, 30, 32, 34, 36 are spaced to take 35 to 55 fins per inch. Pitch 60 is about 0.020 to 0.030 inches. Bent fin height, after bending, is about 0.030 to 0.050 inches. V-shaped notches 64, 66, 68, 70, 72, 74, 76, 78, 80 each has a depth of about 0.005 to 0.008 inches. Refill gaps 62, 82, 84, 86, 88 each has a depth of at least 0.005 inches.

The method of manufacture of tube 10 includes the following steps: Select a tube having a longitudinal axis and having a radially inner spiral fin 20 and having axially spaced outer flat fins with radially outer edge portions 48. Cut peripherally spaced sets of notches 72, 74, 76, 78, 80 and refill gaps 62 in the radially outer edge portion of each outer flat fin. Bend each outer fin 28 until its edge portion 48 contacts the adjacent fin 30. Then, form each outer fin 28, 30, 32, 34, 36 so as to enclose an annular cavity 38, 40, 42, 44, 46 which connects to its sets of refill gaps and notches.

The advantages of tube 10 are indicated hereafter:

A) An improved evaporator tube is provided which can be more easily controlled, so that the evaporator tube does not flood the media reservoir nor starve the replenishing of fluid.

B) A heat transfer tube is provided for use in a refrigeration unit.

C) A heat transfer tube is provided which can be manufactured from a standard tube with outer flat fins.

While the invention has been described in its preferred embodiment, it is to be understood that the words which have been used are words of description rather than limitation and that changes may be made within the purview of the appended claims without departing from the true scope and spirit of the invention in its broader aspects.

What is claimed is:

1. A heat exchanger tube for use in an evaporator tube or tube bundle comprising:

an annular wall or base member having an inner surface, an outer surface and an elongate axis, an inner rib on the inner surface of the annular wall, a plurality of axially spaced fin convolutions on the outer surface of the annular wall, sectors having precisely sized and designed indentations located at specific intervals along an extreme outer edge of the axially spaced fin convolutions, wherein each of the precisely sized and designed indentations on an individual fin having a different designed depth or size than an immediately adjacent indentation, each fin convolution being bent over so that a tip of each convolution is brought into contact or overlapped contact to a side of an adjacent fin convolution and defines therewith an elongated circumferential tunnel or enclosed cavity, each bent over fin convolution being of curvilinear cross-section over substantially its entire height starting from a skewed plane normal to the elongate tube axis, and each of said indentations on said bent over fin convolution forming precisely, different shaped and sized pore openings communicating with said tunnel, the pore openings allowing a media or refrigerant to continuously fill and flow inside the tunnels whereby the heat exchanged through the inner surface, the base member and the fin convolutions will promote and sustain a nucleate boiling process in the media at a maximum efficiency over a wide range of heat fluxes.

2. The tube of claim 1, wherein the different sized pore openings placed at specifically designed intervals along the elongated circumferential tunnels communicating with said tunnels, are triangular, semicircular, trapezoidal or rectangular shaped pore openings.

3. The tube of claim 1, wherein the helical angle of said inner rib is about 45 degrees.

4. The tube of claim 1, wherein said fin convolutions and said inner ribs are integrally with said base member; and each bent over fin convolution is of curvilinear cross-section over substantially its entire height starting from a skewed plane normal to the elongate axis of the tube.

5. The tube of claim 1, wherein the indentations have a selective uniform spacing therebetween and include triangularly shaped notches and rectangularly shaped notches.

6. The tube as defined in claim 1, wherein the tube has an outside diameter of about 0.75 to 1.25 inches, the bent fins have a density of 35 to 55 fins per inch, the bent fin height is about 0.030 to 0.05 inches, and the indentations have a depth of about 0.005 to 0.008.

7. The tube as defined in claim 1, wherein the inner surface having a plurality of ribs, each rib having a helical angle formed by a tangent to a point on the rib and a longitudinal line through the point and parallel to the elongated axis of the tube.

8. The tube as defined in claim 7, wherein the tube has an outside diameter of about 0.75 to 1.25 inches, the bent fins have a density of 35 to 55 fins per inch, the bent fin height is about 0.030 to 0.05 inches, and the indentations have a depth of about 0.005 to 0.008.

* * * * *